US006050320A

United States Patent [19]

Focke

[11] Patent Number: 6,050,320

[45] Date of Patent: Apr. 18, 2000

[54] METHOD AND DEVICE FOR GLUING MATERIAL WEBS, BAND LABELS OR THE LIKE

[75] Inventor: Heinz Focke, Verden, Germany

[73] Assignee: Focke & Co. (GmbH & Co.), Verden, Germany

[21] Appl. No.: 09/133,325

[22] Filed: Aug. 13, 1998

[30] Foreign Application Priority Data

Aug. 21, 1997 [DE] Germany ..... 197 36 388

[51] Int. Cl.[7] ..... B65C 11/04

[52] U.S. Cl. ..... 156/578; 118/315; 118/324; 118/325

[58] Field of Search ..... 156/356, 529, 156/546, 547, 575, 578, DIG. 3, DIG. 4, DIG. 20, DIG. 27, DIG. 34; 118/315, 324, 325; 427/420, 424

[56] References Cited

U.S. PATENT DOCUMENTS

| | | | |
|---|---|---|---|
| 2,494,176 | 1/1950 | Howard | 118/33 |
| 5,462,223 | 10/1995 | Focke et al. | 229/160.1 |

FOREIGN PATENT DOCUMENTS

| | | |
|---|---|---|
| 0 034 790 | 9/1981 | European Pat. Off. . |
| 0 101 278 | 2/1984 | European Pat. Off. . |
| 0 444 547 | 9/1991 | European Pat. Off. . |
| 0 716 024 A1 | 6/1996 | European Pat. Off. . |
| 633 697 | 2/1928 | France . |
| 43 34 745 | 4/1995 | Germany . |
| 44 17 707 | 11/1995 | Germany . |
| 196 16 871 | 10/1997 | Germany . |
| 2 170 178 | 7/1986 | United Kingdom . |

*Primary Examiner*—Jeff H. Aftergut
*Assistant Examiner*—Gladys Piazza
*Attorney, Agent, or Firm*—Sughrue, Mion, Zinn, Macpeak & Seas, PLLC

[57] ABSTRACT

For the application of glue to band labels (10) or other kinds of blanks, the latter are transported by means of a band label conveyor, in particular by means of a suction belt (15) with conveyor strand (16). Glue is applied by means of glue nozzles (30, 31), which spray glue on the band labels (10) in a substantially horizontal direction. In order to prevent any deleterious effects caused by dripping glue remnants, the band labels (10) are transported in a special manner, in such a way that that an already glued band label (10) is located in a position beneath the glue nozzles (30, 31) when the latter are active.

5 Claims, 4 Drawing Sheets

METHOD AND DEVICE FOR GLUING MATERIAL WEBS, BAND LABELS OR THE LIKE

BACKGROUND OF THE INVENTION

The invention relates to a method and device for gluing material webs, stick-on labels, band labels, or the like during transport along a path of movement, with glue being sprayed on the material web, stick-on labels, band labels, etc.

In order to attach band labels or other blanks to packs or to wrappers for packs, the band labels, during their preferably continuous transport, are sprayed with glue as they are moved past a gluing unit with glue nozzles. As their transport continues, the glued band labels are led to the pack or wrapping and affixed thereto.

The band labels or other blanks are held by a band label conveyor during transport, preferably by a suction belt. The band labels lie at a distance from one another on an upright conveyor strand of the band label conveyor and are moved past a gluing unit which sprays glue on the exposed side of the band labels by means of glue nozzles in the horizontal direction.

A device constructed in this fashion for the transport and gluing of band labels or the like is the subject matter of DE 196 47 670.4.

SUMMARY OF THE INVENTION

The invention is based on the technical problem of improving this or a similar device for gluing band labels or other types of labels with respect to achieving a more reliable operating method.

To solve this problem the method according to the invention is characterized in that the band labels or the like can be transported in terms of their speed and spacing in such a manner that while glue is being applied to one band label at least one more band label is situated below the glue nozzle in order to catch dripping glue.

The invention takes into consideration the fact that whenever band labels or other types of labels are glued at high conveying speeds or feeding rates, glue particles or drops, particularly in the region of the glue nozzle, are released and fall downwards on their own weight. The glue portions cause considerable problems by getting into and impairing plant machinery located below. According to the invention, this glue is caught, specifically by a band label or blank which is located in a catching position below the gluing unit or below the glue nozzle while glue is being applied to another band label. As a result of this arrangement, portions of dripping glue are caught by a band label to which glue has already been applied or to which glue will subsequently be applied.

In the device according to the invention, the band label conveyor, in particular the suction belt, is arranged at an inclined angle in the region of the conveyor strand so that the band labels lying at the open side of the band label conveyor—in terms of the vertical plane—are offset to each other. The incline of the band label conveyor or suction belt is set at an angle so that a band label to which glue has already been applied is located directly below the glue nozzle when glue is being applied to the following band label.

The incline of the band label conveyor or suction belt, the speed of the same, the spacing of the band labels and the relative position of the glue nozzles to the conveyor strand of the suction belt are coordinated with respect to each other so that a band label is always positioned under the glue nozzle even when glue is applied in a plurality of cycles or over an extended duration so that throughout an entire gluing operation any particles of glue dripping downwards can be caught by the adjacent band label.

This method and device can also be employed in analogous fashion to gum a continuous material web of packaging material or the like which can be directly transported along an oblique plane.

Further features concerning the method and device are explained more fully in the following according to the exemplary embodiment as shown in drawings showing:

DESCRIPTION OF PREFERRED EMBODIMENTS

Figure 1:
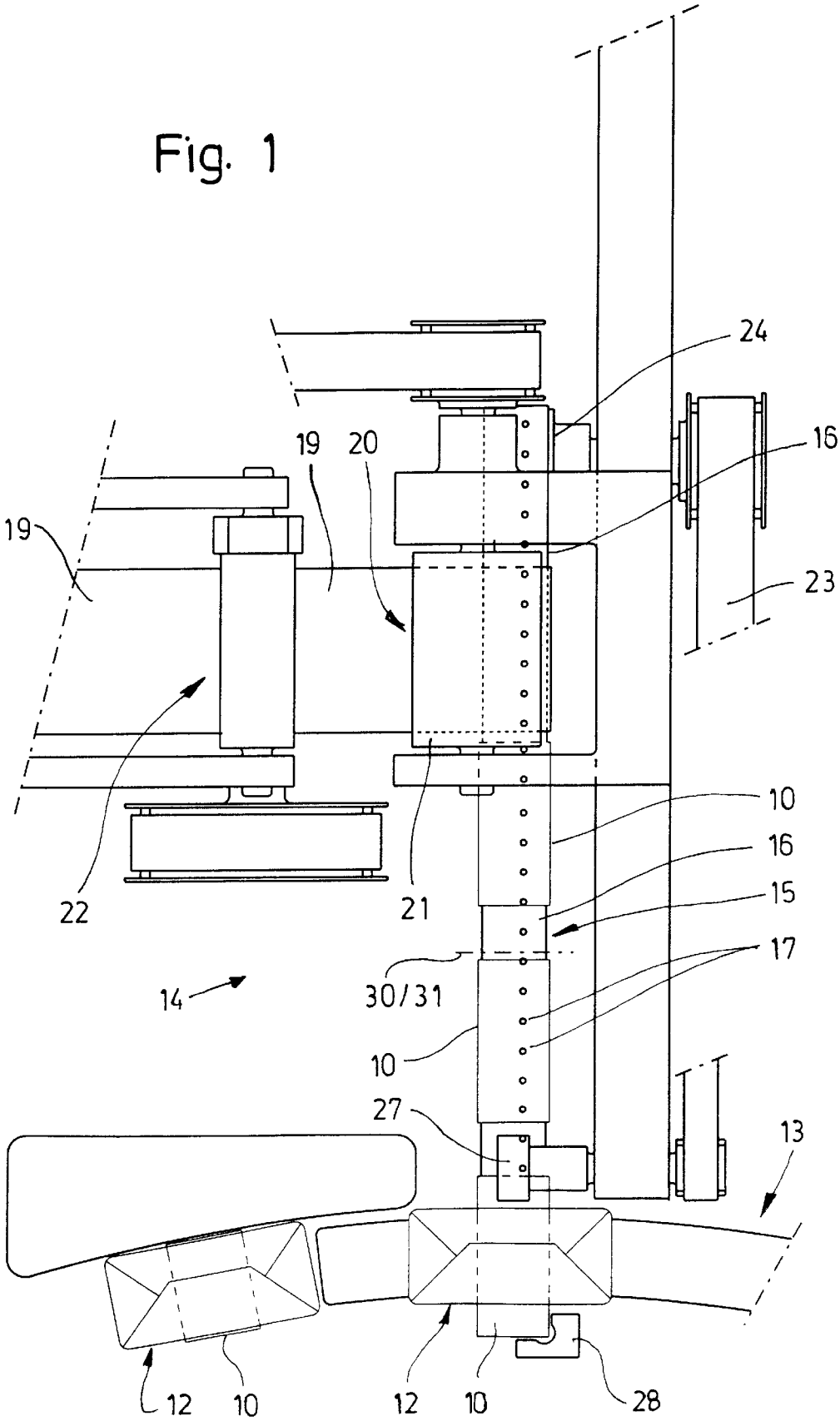
FIG. 1 side view of a unit for handling band labels in conjunction with a packaging machine, FIG. 2 lateral view of a lower area of a band label conveyor facing a folding turret or the like, on an enlarged scale, partially in cross sectional view, FIG. 3 the device according to FIG. 1 and FIG. 2 in plan view and horizontal sectional view, on an even larger scale, FIG. 4 a schematic representation analogous to FIG. 2.

The drawings relate to the preferred area of application of the method and device, namely the application of (revenue) band labels 10 to packs, namely cigarette packs 11. The present case involves cigarette packs 11 of the soft pouch type. For this kind of pack, the rectangular band label 10 is laid centered across an end face 12, with the overhanging areas or legs of the band label 10 being folded against a front side and a rear side of the cigarette pack 11.

The cigarette packs 11 are transported along a path describing a circular arc, namely in pockets (not shown) of a folding turret 13. A band label unit 14 is arranged radial to the folding turret 13 and here above same.

The band label unit 14 has a band label conveyor that conveys the band labels 10 at a precisely specified distance to one another in a downward direction until they are transferred to a cigarette pack 11. The band label conveyor is designed as a suction belt 15. The band labels 10 lie on an upright conveyor strand 16 and are held in place by suction force. For this purpose the suction belt is provided with suction holes 17 along its entire length, the suction holes 17 being impinged upon by negative pressure generated by a suction box 18 on the backside.

In the present embodiment, the band labels 10 are severed from a continuous material web 19. The latter is fed, with vertical orientation and in a horizontal conveying direction, to a cutting unit 20. This comprises a circulating cutting wheel on whose circumference cutting blades are arranged. At each stroke of the machine these blades sever a band label 10 from the material web 19. The band label 10 is transferred from the cutting wheel 21 to the band label conveyor or to the upright suction belt 15. Arranged upstream of the cutting unit 20 is a pair of rollers (22) which feed the material web 19 to the cutting unit 20 in a movement that is coordinated with the entire device.

The elongate, rectangular band labels 10 are positioned on the conveyor strand 16 of the suction belt 15 with their longitudinal extension pointing in the (downward) conveying direction. The suction belt 15 is continuously driven, in the present example by means of a toothed belt 23, in coordination with the packaging machine, in particular with the folding turret 13. The suction belt 15 runs along a plurality, in the present case, three deflection rollers 24, 25, 26. The lower deflection roller 25 extends directly outside of and above the path of movement of the cigarette packs 11. Mounted opposite the deflection roller 25 is a conveying roller, which in cooperation with the deflection roller 25 transports the band label 10 after it has been released by the suction belt 15 to the (lower) end position for transfer to the cigarette pack 11. In this end position the band label 10 rests with its lower edge on a stop 28. Furthermore, the device may be configured in the same manner as taught by DE 196 47 670.4.

As the band labels 10 are being transported by the suction belt 15, glue is applied to the exposed side of the band labels 10. For this purpose, the band labels 10 are moved by the conveyor strand 16 past a stationary gluing unit 29. This is positioned approximately halfway up the conveying path for the band labels. The gluing unit 29 is equipped with glue nozzles 30, 31, which apply glue in the form of glue portions to the band labels 10 during their transport movement. The glue nozzles 30, 31, positioned at a distance from the band labels 10, spray the glue under pressure onto the band labels 10.

The glue pattern made on the exposed side of the band labels 10 may be configured in a number of different ways. The gluing unit 29 shown here generates two rows of adjacent glue spots. Accordingly, as the band labels 10 are moved past, two rows of small dot-shaped glue portions are transferred to the band label 10 in brief intermittent spraying cycles.

Figure 2:
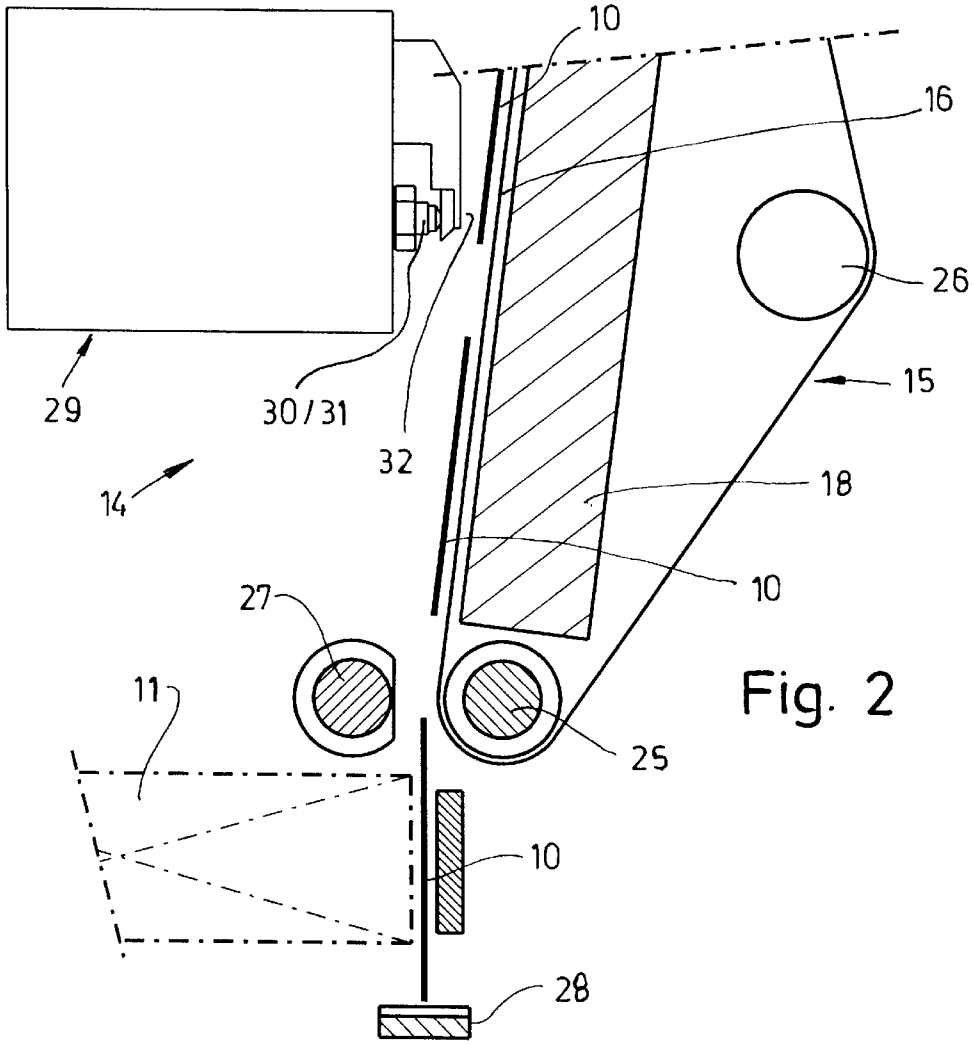
Figure 3:
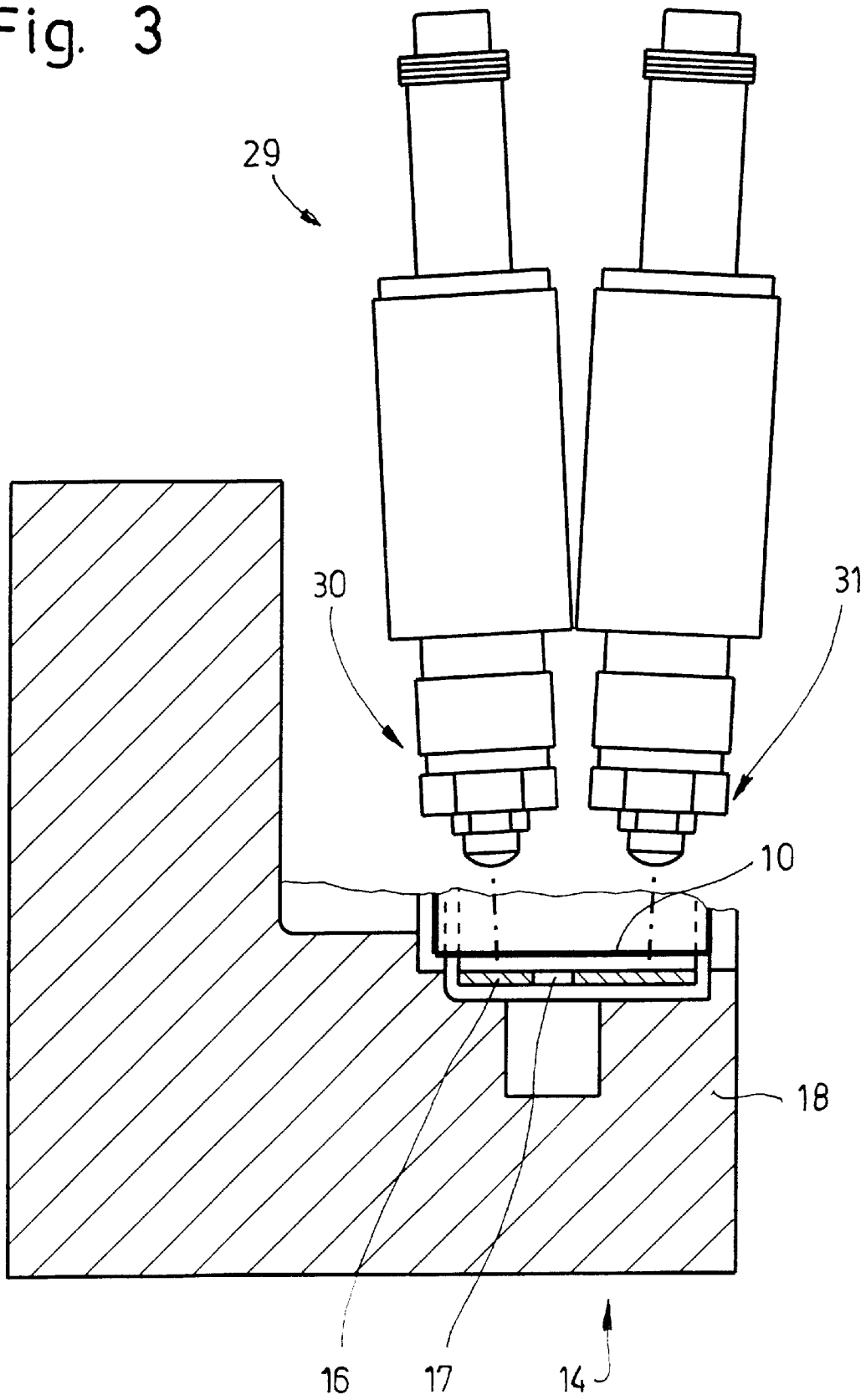
Figure 4:
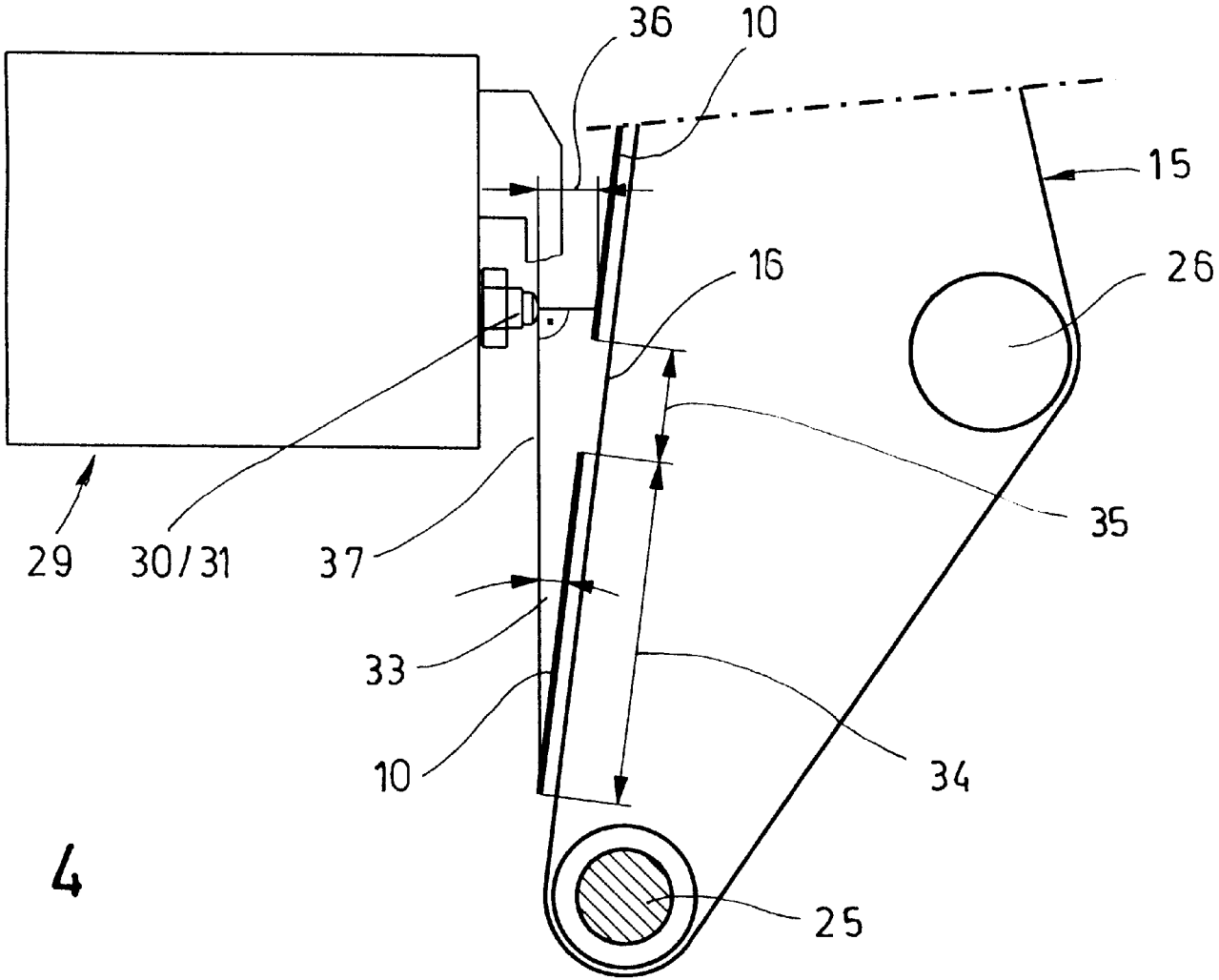

The gluing unit 29 and its glue nozzles 30, 31 are configured such that the glue can be transferred to the band labels 10 practically lossfree. In particular, a closing member 32 is provided which seals the outlets of the glue nozzles 30, 31 during an interruption of operations. At the same it cannot be ruled out that small amounts of glue may escape and fall downward by the force of their own weight. In the present case these small amounts of glue are caught, specifically by a band label 10 positioned underneath the glue nozzles 30, 31 (FIG. 2, FIG. 4). Due to the conveying motion and conveying path, this band label 10, which is already provided with glue, is positioned so that it is located exactly below the glue nozzles 30, 31 or the outlets thereof when glue is being applied to a following band label 10, as seen from the conveying direction. Consequently, any glue particles that drop down are completely caught by the lower band label 10.

In the present exemplary embodiment, the required path of movement of the band labels 10 is achieved by the inclined arrangement of the suction belt and conveyor strand 16. At least one conveying section of the conveyor strand 16 must run along the inclined plane underneath the glue nozzles 30, 31 so that a lower band label 10 assumes the exact position for catching falling glue remnants. In the present embodiment, the suction belt 15 is inclined along the entire length of the conveyor strand 16, specifically by the corresponding offset arrangement of the upper and lower deflection rollers 24, 25.

The application of glue occurs during the conveying movement of the band labels 10. Accordingly, a precise coordination of the movement and spacing of the successive band labels 10 is required in order to achieve the catching effect. As shown in FIG. 4, the geometric conditions are coordinated with each other. In the present example the angle of inclination 33 of the band labels 10 and conveyor strand is 6° to 7°. For band labels 10 having a length 34 of 44 mm in the conveying direction, the spacing 35 between successive band labels 10 is 14.5 mm. Of further interest is the spacing 36 between the outlet of the glue nozzles 30, 31 and the upper side of the band label 10 in the region of glue application. Taken into account in these dimensions is that the first, lower application of glue in the region of the glued band label 10 begins approximately 4 mm from the free, lower edge of the band label 10. The interrelationship of the dimensions and sizes described here ensure that during the entire gluing operation of the upper band label 10 glue remnants can drop down onto the (further transported) lower band label 10 along the suggested fall line 37.

The described effect can also be realized by a different arrangement of the conveying paths for the band labels 10 or other types of blanks, for example, by diverting the band label conveyors to connect to the gluing unit 29. It is also conceivable that the band label conveyor be broken down into a plurality, in particular two sub-conveyors running with a conveyor strand at different levels so that glue dripping from a band label currently being glued can be caught from a previously gummed band label or by the next band label to be gummed.

What is claimed is:

1. A device for gluing sheets of material including webs, stick-on labels and band labels (10), and for transporting the sheets, said device comprising:

a gluing unit (29) containing a plurality of horizontally directed glue nozzles (30, 31);

a suction conveyor belt (15) having a conveyor strand (16) for moving the sheets past said gluing unit and said glue nozzles;

wherein said conveyor strand (16) is spaced from said horizontally directed glue nozzles and runs in a substantially upright conveying plane, wherein the conveyor strand (16) for the sheets is located in a region beneath the glue nozzles (30, 31), and said substantially upright conveying plane is inclined at an acute angle of inclination with respect to an imaginary vertical plane, and wherein said conveying plane is downwardly inclined toward a side of the horizontal glue nozzles (30, 31), and the angle of inclination is such that, during the application of glue horizontally to a sheet in the region of the glue nozzles (30, 31), at least a part of the sheet is located beneath the glue nozzles (30, 31) so that glue dripping from the glue nozzles (30, 31) is caught by the sheet located beneath said glue nozzles (30, 31).

2. The device according to claim 1, further comprising a pair of vertically offset, upper and lower deflecting rollers (24, 25) which guide said conveying strand so that said angle of inclination (33) is between 5° and 10°.

3. The device according to claim 2, wherein said angle is 6° to 7°.

4. The device according to claim 1, wherein the sheets are cigarette band labels, wherein the glue nozzles apply glue in a plurality of dot-shaped portions to each band label (10) while the labels are continuously transported in a conveying direction by the conveying strand (16), and wherein, by virtue of the corresponding relative positioning of adjacent labels during an entire gluing process, a band label, located adjacent each band label in the conveying direction and underneath the glue nozzles (30, 31), is positioned so to catch dripping glue during the entire gluing process.

5. The device according to claim 2, wherein the sheets are cigarette band labels, wherein the glue nozzles apply glue in a plurality of dot-shaped portions to each band label (10) while the labels are continuously transported in a conveying direction by the conveying strand (16), and wherein, by virtue of the corresponding relative positioning of adjacent labels during an entire gluing process, a band label, located adjacent each band label in the conveying direction and underneath the glue nozzles (30, 31), is positioned so to catch dripping glue during the entire gluing process.

* * * * *